US011716578B2

(12) United States Patent
Naderyan et al.

(10) Patent No.: US 11,716,578 B2
(45) Date of Patent: Aug. 1, 2023

(54) MEMS DIE WITH A DIAPHRAGM HAVING A STEPPED OR TAPERED PASSAGE FOR INGRESS PROTECTION

(71) Applicant: Knowles Electronics, LLC, Itasca, IL (US)

(72) Inventors: Vahid Naderyan, Itasca, IL (US); Sung Lee, Itasca, IL (US); Ankur Sharma, Itasca, IL (US); Nick Wakefield, Itasca, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 109 days.

(21) Appl. No.: 17/173,661

(22) Filed: Feb. 11, 2021

(65) Prior Publication Data

US 2022/0256292 A1 Aug. 11, 2022

(51) Int. Cl.

*H04R 19/04* (2006.01)
*H04R 7/06* (2006.01)
*H04R 7/18* (2006.01)

(52) U.S. Cl.

CPC ..... *H04R 19/04* (2013.01); *H04R 7/06* (2013.01); *H04R 7/18* (2013.01); *H04R 2201/003* (2013.01); *H04R 2307/027* (2013.01)

(58) Field of Classification Search

CPC . H04R 19/04; H04R 7/06; H04R 7/18; H04R 2201/003; H04R 2307/027

See application file for complete search history.

(56) References Cited

U.S. PATENT DOCUMENTS

| | | | | |
|---|---|---|---|---|
| 8,901,682 | B2 * | 12/2014 | Reimann | H04R 19/005 381/174 |
| 10,331,026 | B2 * | 6/2019 | Wang | G03F 1/42 |
| 10,609,463 | B2 * | 3/2020 | Cheng | H04R 1/08 |
| 11,117,798 | B2 * | 9/2021 | Lorenz | H04R 1/023 |
| 11,323,797 | B2 * | 5/2022 | Liang | H04R 1/1016 |
| 2008/0212409 | A1 * | 9/2008 | Lutz | B81B 3/0072 367/181 |
| 2013/0056841 | A1 * | 3/2013 | Hsieh | H04R 19/005 257/419 |
| 2014/0084395 | A1 * | 3/2014 | Sparks | B81C 1/00158 257/416 |
| 2014/0299948 | A1 * | 10/2014 | Wang | H04R 7/04 257/416 |
| 2016/0176704 | A1 * | 6/2016 | Cargill | H04R 19/04 257/419 |

(Continued)

FOREIGN PATENT DOCUMENTS

| | | | | |
|---|---|---|---|---|
| CN | 105493521 A | * | 4/2016 | B81B 3/0051 |
| CN | 212064359 U | * | 12/2020 | H04R 19/04 |
| CN | 212259332 U | * | 12/2020 | H04R 19/04 |

(Continued)

*Primary Examiner* — Oyesola C Ojo

(74) *Attorney, Agent, or Firm* — Flener IP & Business Law; Zareefa B. Flener; Ayhan E. Mertogul

(57) ABSTRACT

A MEMS die includes a substrate having an opening formed therein, a diaphragm having a first surface attached around a periphery thereof to the substrate and over the opening, and a backplate separated from a second surface of the diaphragm. The diaphragm includes at least one passage disposed between the first and second surfaces, and the at least one passage has a smaller cross-sectional area at the first surface than at the second surface.

15 Claims, 7 Drawing Sheets

(56) References Cited

U.S. PATENT DOCUMENTS

| | | | | |
|---|---|---|---|---|
| 2021/0136475 | A1* | 5/2021 | Kuntzman | H04R 31/003 |
| 2022/0141596 | A1* | 5/2022 | Lin | B81C 1/00158 381/173 |

FOREIGN PATENT DOCUMENTS

| | | | | | |
|---|---|---|---|---|---|
| CN | 113347540 | A | * | 9/2021 | H04R 19/00 |
| EP | 2182738 | A1 | | 5/2010 | |
| JP | 2005020411 | A | | 1/2005 | |
| JP | 2007180821 | A | | 7/2007 | |
| JP | 2020151829 | A | * | 9/2020 | B81B 7/02 |
| WO | 2015131925 | A1 | | 9/2015 | |

* cited by examiner

MEMS DIE WITH A DIAPHRAGM HAVING A STEPPED OR TAPERED PASSAGE FOR INGRESS PROTECTION

FIELD OF THE DISCLOSURE

The present disclosure relates generally to a microelectromechanical systems (MEMS) die having a diaphragm, and more particularly to MEMS die having a diaphragm including a stepped or tapered pierce or passage for ingress protection.

BACKGROUND

It is known that in the fabrication of MEMS devices often a plurality of devices are manufactured in a single batch process wherein individual portions of the batch process representative of individual MEMS devices are known as dies. Accordingly, a number of MEMS dies can be manufactured in a single batch process and then cut apart or otherwise separated for further fabrication steps or for their ultimate use, which for example without limitation includes as an acoustic transducer or other portion of a microphone.

It has generally been accepted that a diaphragm for a MEMS acoustic transducer can utilize a diaphragm having a passage or pierce disposed therethrough, wherein the size, shape, position, and particular relative geometry of the passage have an effect on the low-frequency roll-off (LFRO) characteristics of the transducer. The pierce or passage includes a certain minimum size to achieve a desired LFRO performance level, where a thicker diaphragm typically requires a larger passage than a thinner diaphragm for the same level of LFRO performance. However, another important consideration for an acoustic transducer diaphragm is the ingress of water and particulate matter into the acoustic transducer through the passage. It is therefore important to minimize the size of the passage to maximize the ingress protection. A stepped or tapered passage that is smaller on an exterior facing side of the diaphragm can satisfy the LFRO performance requirements while significantly improving ingress protection.

DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope.

Figure 1A:
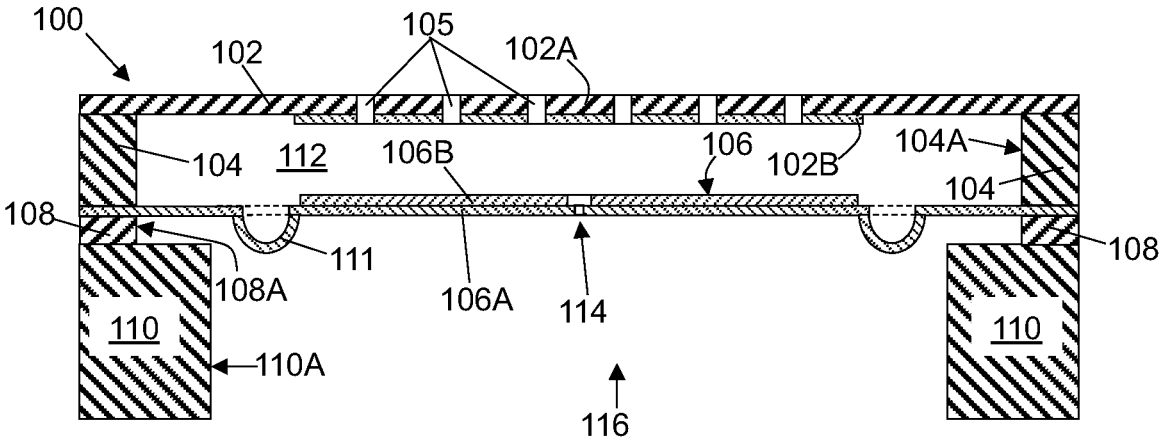
FIG. 1A is a cross-sectional schematic view of a MEMS die, including a diaphragm and backplate according to an embodiment.

In the following detailed description, various embodiments are described with reference to the appended drawings. The skilled person will understand that the accompanying drawings are schematic and simplified for clarity. Like reference numerals refer to like elements or components throughout. Like elements or components will therefore not necessarily be described in detail with respect to each figure.

DETAILED DESCRIPTION

A MEMS diaphragm for example, for an acoustic transducer, can be a single monolithic layer of material or can be made from two or more layers of material. In some embodiments, the diaphragm is made from distinct insulative and conductive layers. However, regardless of the materials or the number of distinct layers that make up the diaphragm, all diaphragms that are used for acoustic transducers also include a pierce or a passage disposed through the diaphragm. When used in an acoustic transducer, for example a microphone, the diaphragm has a surface that is oriented facing the outside environment so that sound signals can propagate to and be registered by the diaphragm. The passage disposed through the diaphragm allows for barometric pressure equalization on both sides of the diaphragm and is important for LFRO performance of the transducer; however, the passage also inherently allows the ingress of water and unwanted particles from the environment into the space behind the diaphragm. Such ingress is undesirable because it can degrade the performance of the transducer.

Balancing the requirements of LFRO performance and ingress protection requires that the passage through the diaphragm be both sufficiently large for LFRO performance, while also being no larger than necessary to maximize protection from the ingress of water and particulates. It is known that a relatively thicker diaphragm will require a passage larger in cross-sectional area than that required for a relatively thinner diaphragm to maintain the same LFRO performance. Another consideration is that the diaphragm can be made from two or more layers of distinct materials, which further affect the size of the passage required to maintain LFRO performance. In general, disclosed herein are a MEMS device having a diaphragm that includes a pierce or passage disposed therethrough that has a tapered or stepped geometry that has a smaller area on an externally facing surface of the diaphragm than on an internally facing surface of the diaphragm.

According to an embodiment, a MEMS die includes a substrate having an opening formed therein, a diaphragm having a first surface attached around a periphery thereof to the substrate and over the opening, and a backplate separated from a second surface of the diaphragm. The diaphragm includes at least one passage disposed between the first and second surfaces, and the at least one passage has a smaller cross-sectional area at the first surface than at the second surface.

According to an embodiment, a microphone device includes a MEMS die comprising a substrate having an opening formed therein, a diaphragm having a first surface attached around a periphery thereof to the substrate and over the opening, and a backplate separated from a second surface of the diaphragm. The diaphragm includes at least one passage disposed between the first and second surfaces, and wherein the at least one passage has a smaller cross-sectional area at the first surface than at the second surface.

In an embodiment, the cross-sectional area of the at least one passage varies continuously from the first surface to the second surface. In another embodiment, the cross-sectional area of the at least one passage includes at least one step-wise increase between the first surface and the second surface. In yet another embodiment, the diaphragm comprises more than one distinct layer of material and the cross-sectional area of the at least one passage varies continuously through at least one of the more than one distinct layers. In a further embodiment, the diaphragm comprises more than one distinct layer of material and the cross-sectional area of the at least one passage is constant through each of the more than one distinct layers. In yet a further embodiment, the at least one passage comprises a plurality of passages.

Turning to FIG. 1A, a MEMS die according to an embodiment is shown schematically in cross-section. The MEMS die, generally labelled 100, includes a backplate 102, a first spacer 104, a diaphragm 106, an optional second spacer 108, and a substrate 110. The diaphragm 106 has a first surface attached around a periphery thereof to the substrate 110 and over an opening 116 disposed through the substrate (via the optional spacer 108 in FIG. 1A). The backplate 102 and the first spacer 104 can be separate components as shown or in another embodiment can be a unitary component. The diaphragm 106 and the backplate 102 can be any shape. Further, the first spacer 104 with or without the backplate 102, the second spacer 108, and the substrate 110 may all be part of a single unitary body.

In an embodiment, the diaphragm 106 may be made from a single monolithic layer of material (see for example FIGS. 2A-2D). In another embodiment as shown in the schematic view of FIG. 1A, the embodiment 106 is illustrated to have two layers. The diaphragm 106, in this embodiment, is made of an insulative layer 106A and a conductive layer 106B. In an embodiment, the insulative layer 106A is made from Silicon Nitride, the conductive layer 106B is made from polycrystalline Silicon, and the substrate 110 is made from Silicon. In an embodiment, an insulative layer 106A of Silicon Nitride has a thickness in a range between about 0.2 μm and about 2.0 μm, whereas in other embodiments the thickness may be outside of this range. In an embodiment, a conductive layer 106B of polycrystalline Silicon has a thickness in a range between about 0.2 μm and about 2.0 μm, whereas in other embodiments the thickness may be outside of this range. Other embodiments of the diaphragm 106 can include one, two, or more layers of the above-noted materials or other materials as may be known in the art, and having thicknesses within or outside of the above-noted ranges as may be known in the art.

In an embodiment the backplate 102 includes one or more holes 105 disposed therethrough. The insulative layer 106A in some embodiments can include one or more structures, for example a corrugation 111 (or more than one corrugation 111) disposed circumferentially around the insulative layer 106A. Other embodiments lack the corrugation 111 (as indicated by the dashed lines disposed across the corrugation in FIG. 1A). The corrugation 111 is helpful in regard to reducing the effect of the stresses on the diaphragm 106 and increasing the compliance of the diaphragm 106.

The diaphragm 106 further includes a pierce or passage 114 disposed entirely therethrough. FIG. 1A illustrates the passage 114 as having a constant area through each of the distinct insulative layer 106A and conductive layer 106B. However, in other embodiments the passage 114 has any of a variety of different geometries as will be further described hereinbelow. Additional structure of and a process for fabrication of a portion of the MEMS die 100 are also further described hereinbelow.

Still referring to FIG. 1A, in an embodiment, the backplate 102 has a first surface 102A, which is part of an insulative or dielectric layer, and a second surface 102B, which is part of a conductive layer (a first electrode) separated from the conductive layer 106B of the diaphragm 106, and opposite the first surface 102A. The diaphragm 106 is supported between and constrained by the first spacer 104 (or a bottom portion of the back plate 102 curved to be generally orthogonal to the back plate 102) and the optional second spacer 108. The first spacer 104 has a curved interior wall 104A. The second surface 102B of the backplate 102, an internal surface of the of the diaphragm 106, and the interior wall 104A of the first spacer 104 define a chamber 112.

The optional second spacer 108 has a curved interior wall 108A. The diaphragm 106 is fully constrained (by the first spacer 104 and the optional second spacer 108) along a boundary that is defined by a curve along which the interior wall 104A of the first spacer 104 meets the diaphragm 106. The substrate 110 also has a curved interior wall 110A, which defines an opening 116 that extends through the substrate 110 to the surrounding environment. In an embodiment, the first and optional second spacers 104 and 108 are part of the sacrificial material of the MEMS die 100, and the walls 104A and 108A of the spacers are made from a time-limited etch front of the sacrificial material. The passage 114 allows for pressure equalization of the chamber 112 and the surrounding environment. The passage 114 is important for LFRO performance of the transducer; however, the passage also inherently allows the ingress of water and unwanted particles from the environment into the chamber 112. Such ingress is undesirable because it can degrade the performance of the transducer 100.

The diaphragm 106 as noted hereinabove can be made from a single layer of a material or two or more layers of distinct materials. Referring now to FIGS. 2A-2D, in an embodiment of a single layer diaphragm 106, exemplary geometries of a passage 114 are shown disposed through the single layer. The diaphragm 106 is illustrated in the same orientation as shown in FIG. 1A, with a bottom surface facing the opening 116 and a top surface facing the chamber 112.

Figure 2A:
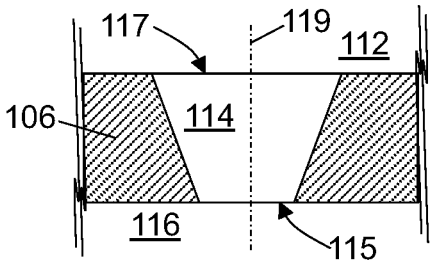
FIG. 2A is cross-sectional elevational view of an exemplary geometry for a passage disposed through a single-layer diaphragm.

In a first embodiment shown in FIG. 2A, the passage 114 has a smaller area on a first side 115 (the "small side") facing the opening 116 than on a second side 117 (the "large side") facing the chamber 112. In this embodiment, the passage 114 is shown to be generally symmetrical (at least in the plane of the page) about a centerline 119. However, in other embodiments, neither the passage 114 nor either the small or the large side 115, 117, respectively, thereof need be symmetrical in any regard or otherwise centered with regard to the centerline 119. Furthermore, the actual cross-sectional shapes of the passage 114 at any point along the passage 114, and the areas at both the small and the large sides 115, 117, respectively, thereof can, in different embodiments, be circular, triangular, square, pentagonal, hexagonal, oval, racetrack shaped, or any other shape as desired or otherwise known in the art including but not limited to the shapes of any regular or irregular polygons.

Still referring to FIG. 2A, in cross section the passage 114 is illustrated to vary continuously from the small side 115 to the large side 117. In this embodiment, the continuous variation in size is illustrated by sidewalls that are straight lines in the plane of FIG. 2A. In other embodiments the sidewalls can be straight lines in some cross-sectional planes but curvilinear lines in other cross-sectional planes disposed through the passage 114, for example in embodiments where the passage 114 is has an irregular polygonal shape at any slice between the small side 115 and the large side 117.

Figure 2B:
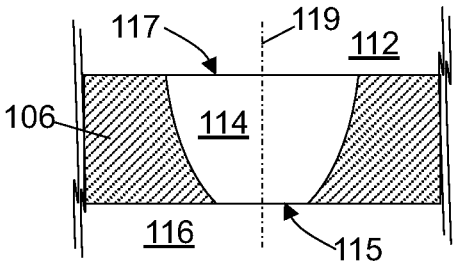
FIG. 2B is cross-sectional elevational view of another exemplary geometry for a passage disposed through a single-layer diaphragm.

Referring to FIG. 2B, in another embodiment the passage 114 again has a small side 115 facing the opening 116 and a large side 117 facing the chamber 112. In this embodiment, the passage 114 is again shown to be generally symmetrical (at least in the plane of the page) about the centerline 119; however, in other embodiments, neither the passage 114 nor either the small or the large side 115, 117, respectively, thereof need be symmetrical in any regard or otherwise centered with regard to the centerline 119. In cross section the passage 114 in FIG. 2B is again illustrated to vary continuously from the small side 115 to the large side 117. In this embodiment, the continuous variation in size is illustrated by lines that are concave with respect to the passage 114 in the plane of FIG. 2B, where the lines are representative of curvilinear sidewalls. In other embodiments the sidewalls can be concave curvilinear lines in some cross-sectional planes but straight lines (or convex curvilinear lines—see FIG. 2C) in other cross-sectional planes disposed through the passage 114, for example in embodiments where the passage 114 is has an irregular polygonal shape at any slice between the small side 115 and the large side 117.

Figure 2C:
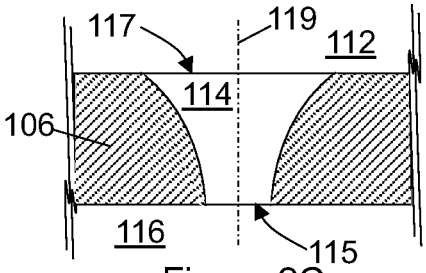
FIG. 2C is cross-sectional elevational view of yet another exemplary geometry for a passage disposed through a single-layer diaphragm.

Referring now to FIG. 2C, in another embodiment the passage 114 again has a small side 115 facing the opening 116 and a large side 117 facing the chamber 112. In this embodiment, the passage 114 is once again shown to be generally symmetrical (at least in the plane of the page) about the centerline 119; however, in other embodiments, neither the passage 114 nor either the small or the large side 115, 117, respectively, thereof need be symmetrical in any regard or otherwise centered with regard to the centerline 119. In cross section the passage 114 in FIG. 2C is once again illustrated to vary continuously from the small side 115 to the large side 117. In this embodiment, the continuous variation in size is illustrated by lines that are convex with respect to the passage 114 in the plane of FIG. 2C, where the lines are again representative of curvilinear sidewalls. In other embodiments the sidewalls can be convex curvilinear lines in some cross-sectional planes but straight lines or concave curvilinear lines in other cross-sectional planes disposed through the passage 114, for example in embodiments where the passage 114 is has an irregular polygonal shape at any slice between the small side 115 and the large side 117. In further embodiments, the sidewalls can be any of convex or concave curvilinear or straight lines in some cross-sectional planes but step-wise varying (for example—see FIG. 2D) in other cross-sectional planes.

Figure 2D:
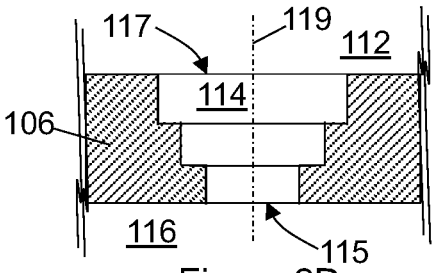
FIG. 2D is cross-sectional elevational view of a further exemplary geometry for a passage disposed through a single-layer diaphragm.

Referring now to FIG. 2D, in another embodiment the passage 114 again has a small side 115 facing the opening 116 and a large side 117 facing the chamber 112. In this embodiment, the passage 114 is once again shown to be generally symmetrical (at least in the plane of the page) about the centerline 119; however, in other embodiments, neither the passage 114 nor either the small or the large side 115, 117, respectively, thereof need be symmetrical in any regard or otherwise centered with regard to the centerline 119. In cross section the passage 114 in FIG. 2D is illustrated to vary step-wise discontinuously from the small side 115 to the large side 117. Three step-wise increments are shown from the small side 115 to the large side 117 in the plane of FIG. 2D; however, in other embodiments there can be two step-wise increments or more than three step-wise increments. Further, in other embodiments the sidewalls can be step-wise discontinuous in some cross-sectional planes, but straight, convex, or concave curvilinear lines in other cross-sectional planes disposed through the passage 114, for example in embodiments where the passage 114 is has an irregular polygonal shape at any slice between the small side 115 and the large side 117. Further, the passage 114 can have a geometry including any combination of any of the above embodiments described with regard to FIGS. 2A-2D.

Referring now to FIGS. 3A-3D, in an embodiment of a two-layer diaphragm 106, exemplary embodiments of a passage 114 are shown disposed therethrough. The diaphragm 106 in FIGS. 3A-3D is illustrated in the same orientation as shown in FIGS. 1 and 2A-2D, with a bottom surface facing the opening 116 and a top surface facing the chamber 112.

Figure 3A:
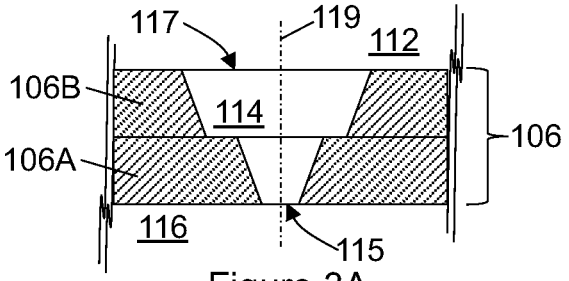
FIG. 3A is cross-sectional elevational view of an exemplary geometry for a passage disposed through a two-layer diaphragm.

In an embodiment shown in FIG. 3A, the passage 114 has a smaller area on the small side 115 facing the opening 116 than on the large side 117 facing the chamber 112. In this embodiment, the passage 114 is shown to be generally symmetrical (at least in the plane of the page) about a centerline 119. However, in other embodiments, neither the passage 114 nor either the small or the large side 115, 117, respectively, thereof need be symmetrical in any regard or otherwise centered with regard to the centerline 119. Furthermore, the actual cross-sectional shapes of the passage 114 at any point along the passage 114, and the areas at both the small and the large sides 115, 117, respectively, thereof can, in different embodiments, be circular, triangular, square, pentagonal, hexagonal, oval, racetrack shaped, or any other shape as desired or otherwise known in the art including but not limited to the shapes of any regular or irregular polygons.

Still referring to FIG. 3A, in cross-section the passage 114 is illustrated to continuously vary in size from the small side 115 of the diaphragm 106 to a top side of the layer 106A, wherein the passage 114 discontinuously increases in size to a bottom side of the layer 106B and from there again continuously varies in size to the to the large side 117 of the diaphragm 106. Although shown in the plane of FIG. 3A, as increases in width, in reality the increases in size described are increases in cross-sectional area of the passage 114. In this embodiment, the continuous variation in cross-sectional area is illustrated by sidewalls that are straight lines in the plane of FIG. 3A; however, in other embodiments the variation in cross-sectional area through one or both of the layers 106A, 106B can be any one or combination of the variations in cross-sectional area as described hereinabove in regard to FIGS. 2A-2D for a single layer diaphragm 106, and further wherein the cross-sectional area of the passage 114 may be continuous or discontinuous from one layer to the next. For example, referring to FIG. 3B, in this embodiment the cross-section the passage 114 is illustrated to discontinuously vary in size from the small side 115 of the diaphragm 106 to the large side 117 of the diaphragm 106. However, in this embodiment, the passage 114 maintains a constant cross-sectional area through each of the layers 106A, 106B.

Figure 1B:
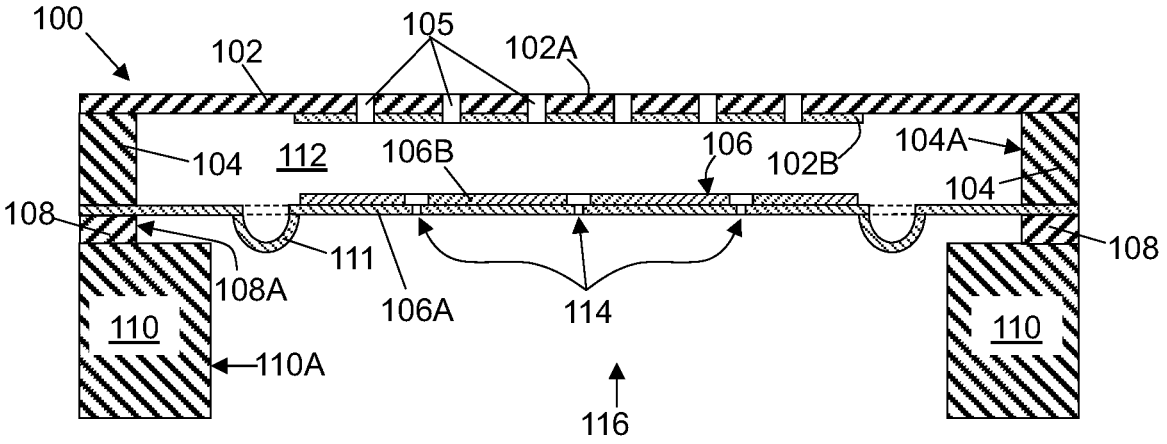
FIG. 1B is a cross-sectional schematic view of a MEMS die, including a diaphragm and backplate according to another embodiment.

Referring briefly to FIG. 1B, in some embodiments, there are two or more passages 114 as described hereinabove. The two or more passages 114 can individually all have the same geometries (as shown in FIG. 1B) or different geometries, shapes, and/or sizes. For example, in an embodiment, at least one of the two or more passages 114 includes a continuously varying cross-sectional area through at least one layer of the diaphragm 106, whereas the other of the two or more passages 114 can have cross-sectional areas that vary continuously or discontinuously. In another embodiment wherein the diaphragm 106 has two or more layers, at least one of the two or more passages 114 includes a constant cross-sectional area through at least one of the two or more layers of the diaphragm 106, whereas the other of the two or more passages 114 can have cross-sectional areas that vary continuously or discontinuously through at least one of the two or more layers of the diaphragm 106.

The two or more passages 114 further can be arranged through the diaphragm 106 in any arrangement, pattern, or predetermined geometric relationship as is known in the art or otherwise, whether centered on or offset from a center of the diaphragm 106 for the purpose of controlling the low frequency roll off performance of the MEMS die 100 when, for example without limitation, used as an acoustic transducer or for any other purpose as is known in the art, as needed or desired, while providing ingress protection as noted hereinabove.

Without being held to any particular theory, to maintain a desired LFRO performance level the size in terms of area or maximum and/or minimum cross-sectional dimension, and/or the shape of the one or more passages 114 disposed through a diaphragm 106 can be dependent on the number and positioning of the one or more passages 114, on the particular materials comprising the one or more layers of the diaphragm 106, and/or on the thickness of the one or more layers of the diaphragm 106 through which the one or more passages 114 are disposed. However, it has been shown that making the area of a side of the one or more passages 114 facing the opening 116 smaller than the area of a side of the one or more passages 114 facing the chamber 112 beneficially maintains the same level of LFRO performance as achieved for a uniformly sized passage disposed through both layers while further restricting ingress through the diaphragm.

For example, in an exemplary embodiment a two-layer diaphragm having a 0.5 μm thick conductive layer of polycrystalline Silicon and a 1.1 μm thick layer of Silicon Nitride achieves a given desired level of LFRO performance with a 13.5 μm diameter circular hole uniformly disposed through both layers. The same two-layer diaphragm maintains the desired LFRO performance with a 12 μm constant diameter circular hole disposed through the Silicon Nitride layer (opening 116 facing) and a 30 μm constant diameter circular hole through the polycrystalline Silicon layer (chamber 112 facing). In another exemplary embodiment a two-layer diaphragm having a 0.5 μm thick conductive layer of polycrystalline Silicon and a 0.5 μm thick layer of Silicon Nitride achieves a given desired level of LFRO performance with a 14.5 μm diameter circular hole uniformly disposed through both layers. The same two-layer diaphragm maintains the desired LFRO performance with a 12 μm constant diameter circular hole disposed through the Silicon Nitride layer (opening 116 facing) and a 30 μm constant diameter circular hole through the polycrystalline Silicon layer (chamber 112 facing).

During operation of the MEMS die 100, for example as an acoustic transducer 100, electric charge is applied to the conductive layer of the backplate 102 and to a conductive layer, for example layer 106B, of the diaphragm 106 thereby inducing an electric field between the backplate 102 and the diaphragm 106 and creating an electrostatic bias on the diaphragm 106. Movement of the air (e.g., resulting from sound waves) pushes against the surface of the diaphragm 106 facing the opening 116 causing the diaphragm 106 to deflect (enter a deflection state) and to deform. This deformation causes a change in the capacitance between the backplate 102 and the diaphragm 106 which can be detected and interpreted as sound.

Figure 4:
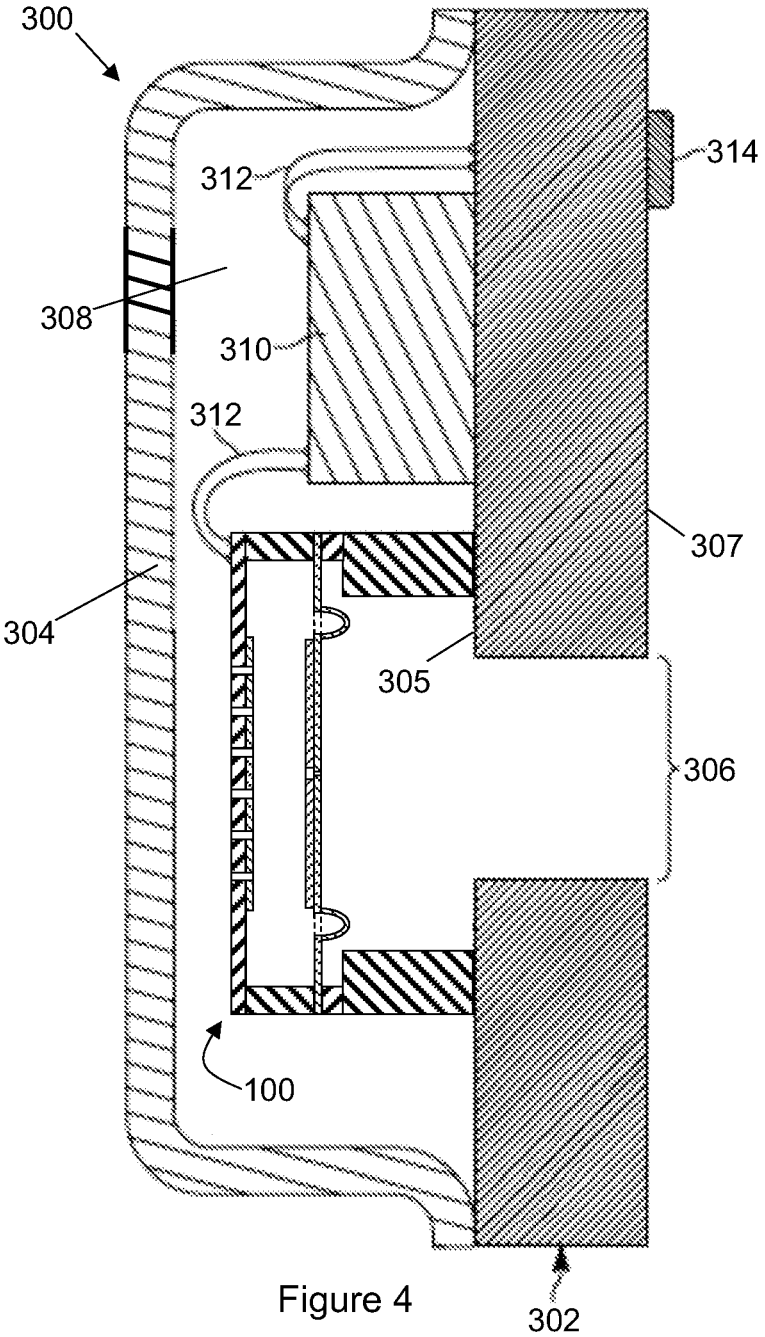
FIG. 4 is a cross-sectional view of a microphone assembly according to an embodiment.

Turning to FIG. 4, the MEMS die 100 used as an acoustic transducer 100 is configured to fit within a microphone assembly, generally labeled 300. The assembly 300 includes a housing including a base 302 having a first surface 305 and a second surface 307. The housing further includes a cover 304 (e.g., a housing lid), and an acoustic port 306. In an embodiment the port 306 extends between the first surface 305 and the second surface 307. In one implementation, the base 302 is a printed circuit board. The cover 304 is coupled to the base 302 (e.g., the cover 304 may be mounted onto a peripheral edge of the base 302). Together, the cover 304 and the base 302 form an enclosed volume 308 for the assembly 300.

As shown in FIG. 4, the acoustic port 306 is disposed on the base 302 and is structured to convey sound waves to the MEMS acoustic transducer 100 located within the enclosed volume 308. In other implementations, the acoustic port 306 is disposed on the cover 304 and/or a side wall of the cover 304. In some embodiments, the assembly 300 forms part of a compact computing device (e.g., a portable communication device, a smartphone, a smart speaker, an internet of things (IoT) device, etc.), where one, two, three or more assemblies may be integrated for picking-up and processing various types of acoustic signals such as speech and music.

The assembly 300 includes an electrical circuit disposed within the enclosed volume 308. In an embodiment, the electrical circuit includes an integrated circuit (IC) 310. In an embodiment the IC 310 is disposed on the first surface 305 of the base 302. The IC 310 may be an application specific integrated circuit (ASIC). Alternatively, the IC 310 may include a semiconductor die integrating various analog, analog-to-digital, and/or digital circuits. In an embodiment the cover 304 is disposed over the first surface 305 of the base 302 covering the MEMS acoustic transducer 100 and the IC 310.

Figure 3B:
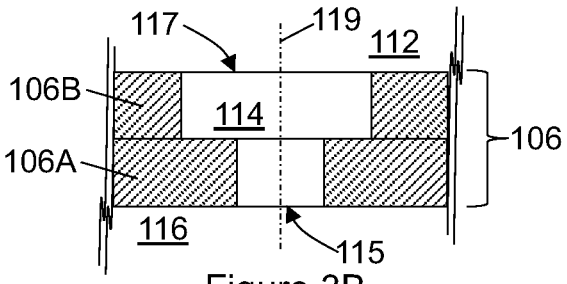
FIG. 3B is cross-sectional elevational view of another exemplary geometry for a passage disposed through a two-layer diaphragm.

In the assembly 300 of FIG. 4, the MEMS acoustic transducer 100 is illustrated as being disposed on the first surface 305 of the base 302. The MEMS acoustic transducer 100 converts sound waves, received through acoustic port 306, into a corresponding electrical microphone signal. FIG. 4 illustrates a schematic representation of the structure of the MEMS acoustic transducer 100 having a two-layer diaphragm 106 having a single passage 114 disposed therethrough as illustrated in FIG. 3B; however, it is understood that the transducer 100 represented in FIG. 4 may have any variation or combination of a diaphragm having one, two, or more layers and one or more passages 114 having any geometry or combination of geometries as described hereinabove with regard to FIGS. 2A-3B.

The transducer 100 generates an electrical signal (e.g., a voltage) at a transducer output in response to acoustic activity incident on the port 306. As shown in FIG. 4, the transducer output includes a pad or terminal of the transducer that is electrically connected to the electrical circuit via one or more bonding wires 312. The assembly 300 of FIG. 4 further includes electrical contacts, shown schematically as contacts 314, typically disposed on a bottom surface of the base 302. The contacts 314 are electrically coupled to the electrical circuit. The contacts 314 are configured to electrically connect the assembly 300 to one of a variety of host devices.

FIGS. 5A-5H depict a two-layer diaphragm 106 representative of a portion of the MEMS die 100 in sequential states of fabrication. The die or work piece being fabricated is illustrated in cross-section with a "top" side for description purposes disposed on the left side thereof. As noted hereinabove, a plurality of MEMS devices can be manufactured in a single batch process. Individual portions of the batch process representative of individual MEMS devices are known as dies. Accordingly, a number of MEMS dies can be manufactured in a single batch process and then cut apart or otherwise separated for further fabrication steps or for their ultimate use, which for example without limitation includes as an acoustic transducer or other portion of a microphone.

It should be noted that the reference numerals used in the description of the fabrication process illustrated in FIGS. 5A-5H are 400 series numbers generally corresponding to the 100 series numbers used for analogous structures in FIGS. 1-4. So, for example, as a result of the fabrication process the cylindrical wafer 410 in FIGS. 5A-5H eventually becomes the substrate 110 shown in FIG. 1A. In addition all of the deposition steps for adding layers of material as described hereinbelow can be, for example without limitation, via a vapor deposition process such as a low pressure chemical vapor deposition process or the like as is known in the art.

Figure 5A:
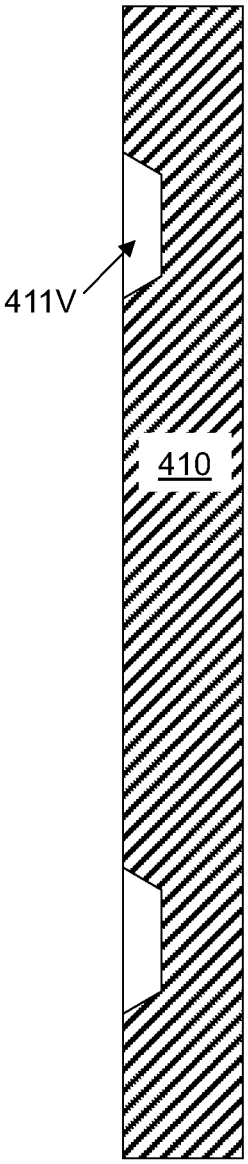
FIG. 5A depicts a stage in an exemplary fabrication process for a portion of the MEMS die of FIG. 1A.

Starting with FIG. 5A, in an embodiment an annular void 411V is created in the top surface of a cylindrical wafer 410, for example, by grinding, etching, or polishing the top surface of the wafer 410 of substrate material (shown in cross-section) comprising, for example without limitation, Silicon. The wafer 410 in an embodiment has a thickness (left to right in FIGS. 5A-5H and not shown to scale) in a range of about 500 μm to about 725 μm, whereas in other embodiments the thickness may be outside of this range.

Figure 5B:
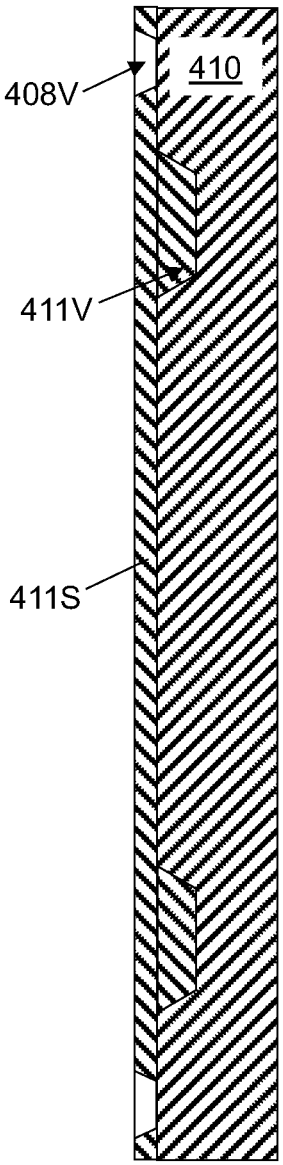
FIG. 5B depicts a stage in an exemplary fabrication process for a portion of the MEMS die of FIG. 1A subsequent to the stage shown in FIG. 5A.

Referring to FIG. 5B, in a subsequent step in an embodiment, a layer 411S of Tetraethyl Orthosilicate (TEOS) Oxide or other sacrificial material is deposited onto a portion of a top side of the wafer 410 thereby filling the annular void 411V and extending above it. Following deposition of the layer 411S of TEOS Oxide or other sacrificial material, a second annular void 408V is created schematically as illustrated entirely through the layer 411S to expose a top surface of the substrate 410, for example, by grinding, etching, or polishing the layer 411S.

Figure 5C:
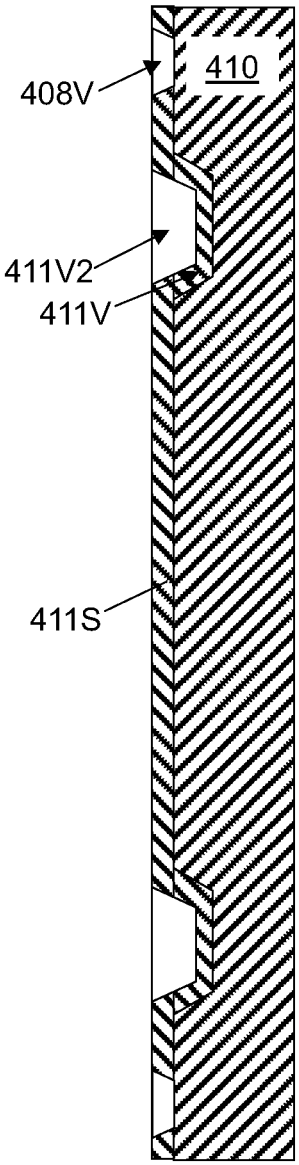
FIG. 5C depicts a stage in an exemplary fabrication process for a portion of the MEMS die of FIG. 1A subsequent to the stage shown in FIG. 5B.
Figure 5D:
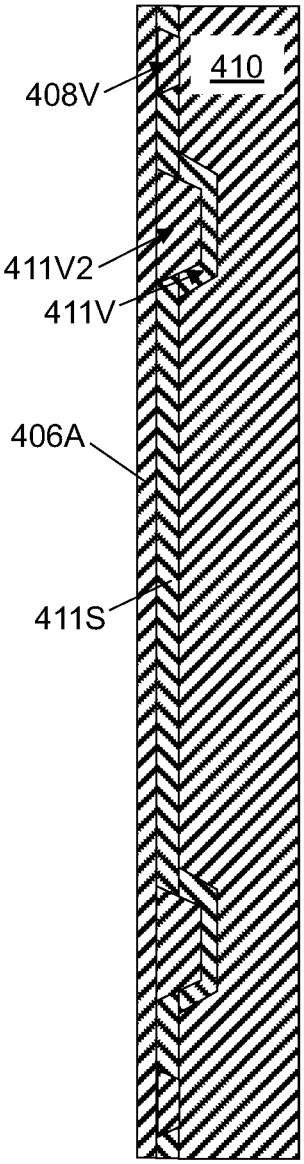
FIG. 5D depicts a stage in an exemplary fabrication process for a portion of the MEMS die of FIG. 1A subsequent to the stage shown in FIG. 5C.

Referring to FIG. 5C, in a subsequent step in an embodiment, a third annular void 411V2 is created through the layer 411S for example, by grinding, etching, or polishing the layer 411S, at least partially into the annular void 411V, which is filled with material of the layer 411S. FIG. 5D illustrates a further stage in an embodiment of the fabrication process wherein a layer 406A of insulative material, for example without limitation Silicon Nitride, is applied over the top of the workpiece as shown, entirely covering the layer 411S of TEOS Oxide or other sacrificial material and filling the second and third annular voids 408V and 411V2, respectively. In an embodiment, the portion of the layer of 406A of insulative material disposed continuously across the workpiece has a thickness in a range of about 0.2 μm to about 2.0 μm, whereas in other embodiments the thickness may be outside of this range.

Figure 5E:
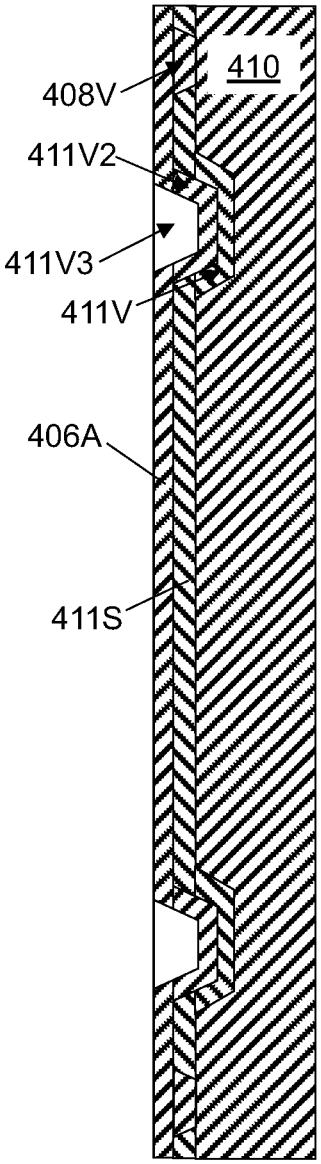
FIG. 5E depicts a stage in an exemplary fabrication process for a portion of the MEMS die of FIG. 1A subsequent to the stage shown in FIG. 5D.

FIG. 5E illustrates a subsequent step in an embodiment wherein a fourth annular void 411V3 is created into the layer 406A, for example, by grinding, etching, or polishing the layer 406A, at least partially into the second annular void 411V2, which is filled with material of the layer 406A of insulative material. The remaining layer 406A of insulative material in FIG. 5E is representative of the layer 106A in FIG. 1A including the annular portion of insulative material remaining within the third annular void 411V2, which is representative of the corrugation 111.

Figure 5F:
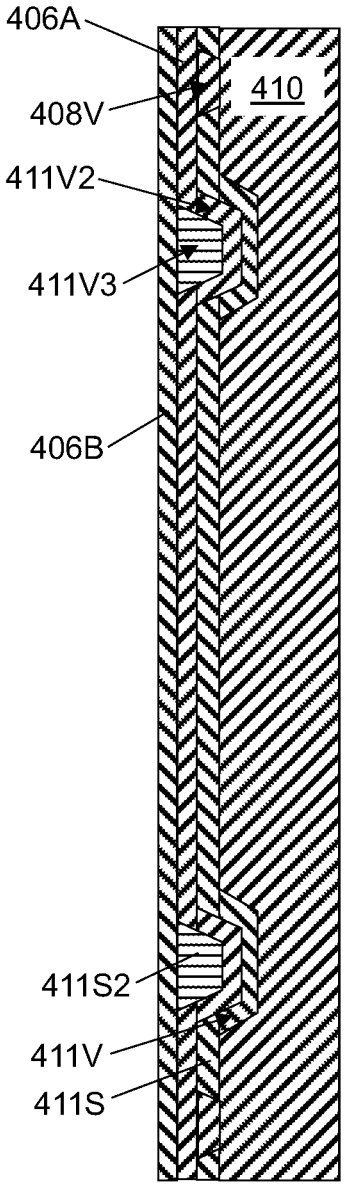
FIG. 5F depicts a stage in an exemplary fabrication process for a portion of the MEMS die of FIG. 1A subsequent to the stage shown in FIG. 5E.

FIG. 5F represents a further subsequent step in an embodiment, wherein the fourth annular void 411V3 is filled with a second layer 411S2 of TEOS Oxide or other sacrificial material, and a layer 406B of conductive material, for example, polycrystalline Silicon is applied over a top side of the work piece.

Figure 5G:
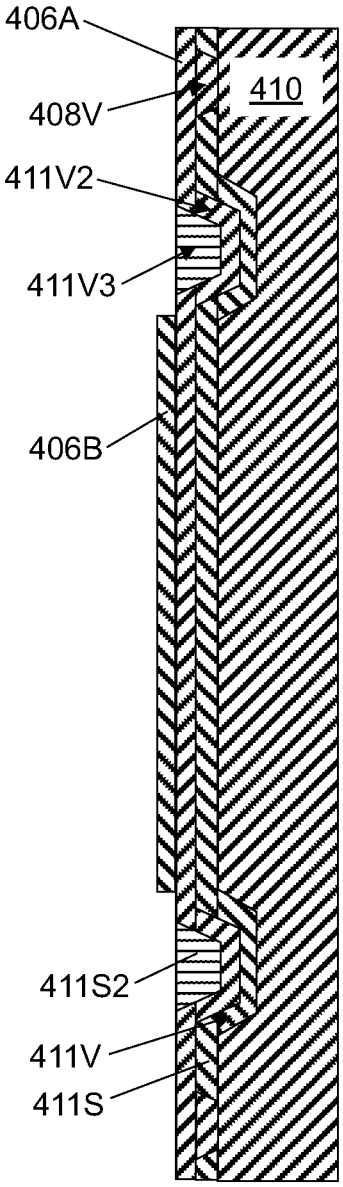
FIG. 5G depicts a stage in an exemplary fabrication process for a portion of the MEMS die of FIG. 1A subsequent to the stage shown in FIG. 5F.

Referring to FIG. 5G, in a subsequent step of an embodiment, the layer 406B is reduced in size so as to be radially within the fourth annular void 411V3, for example, by grinding, etching, or polishing the layer 406B. Subsequently, the second layer 411S2 of sacrificial material, is released or removed, for example, by grinding, etching, or polishing.

Figure 5H:
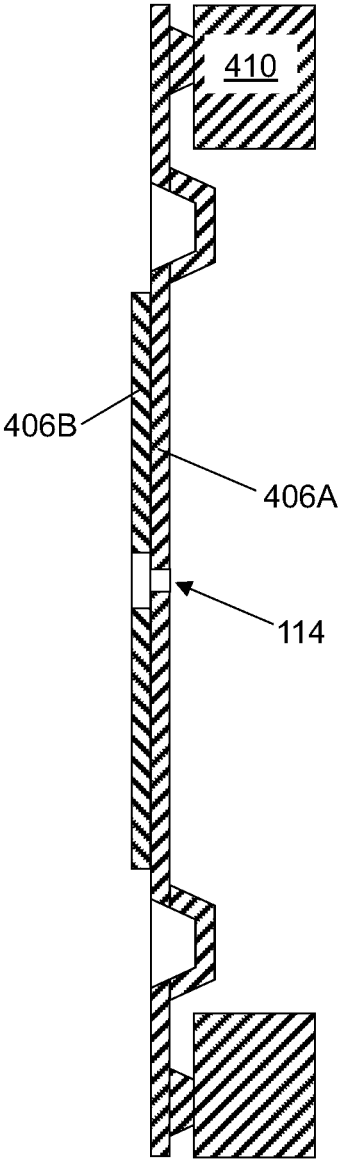
FIG. 5H depicts a stage in an exemplary fabrication process for a portion of the MEMS die of FIG. 1A subsequent to the stage shown in FIG. 5G.

In FIG. 5H, a central portion of the wafer 410 has been removed for example, by grinding, etching, or polishing, and the layers 411S of sacrificial material are removed or released, by grinding, etching, polishing, or another chemical process as is known in the art. Finally, the remaining layers 406A and 406B of insulative and conductive materials, respectively, are pierced with a passage 114, which is fully described hereinabove with regard to FIGS. 2A-3B. The piercing and resulting creation of the passage 114 can be accomplished, for example, by grinding, etching, or polishing, or as otherwise known in the art.

The remaining structure illustrated in FIG. 5H is schematically representative of the structure of the MEMS die 100 illustrated in FIG. 1A without the backplate 102 and the first spacer 104, wherein the layers 406A and 406B in FIG. 5H are the equivalent of the diaphragm layers 106A and 106B in FIG. 1A. In other embodiments, one or more of the steps described herein may be executed in a different order than presented or may otherwise be omitted or substituted for by other steps as are known in the art for the fabrication of a diaphragm, without limitation including a single-layer or multi-layer diaphragm, with or without one or more corrugations.

The passage 114 is not necessarily at the geometric center of the layer 406B of polycrystalline Silicon, and may be offset therefrom. In some embodiments, there are two or more passages 114, wherein the two or more passages 114 can have the same or different geometries, shapes, and/or sizes. The two or more passages 114 as described hereinabove can be arranged through the diaphragm 106 (layers 406A, 406B) for the purpose of controlling the low frequency roll off performance of the MEMS die 100 when used as an acoustic transducer 100, as needed or desired, while providing ingress protection as noted hereinabove.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

Unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A microelectromechanical system (MEMS) die, comprising:

a substrate having an opening formed therein;

a diaphragm having a first surface attached around a periphery thereof to the substrate and over the opening; and a backplate separated from a second surface of the diaphragm; wherein the diaphragm comprises first and second distinct layers of material, wherein the second layer is disposed directly on the first layer; wherein the diaphragm includes at least one passage disposed between the first and second surfaces, wherein the at least one passage has a smaller cross-sectional area at the first surface than at the second surface, and wherein the cross-sectional area of the at least one passage varies continuously through at least one of the first and second distinct layers of material.

2. The MEMS die of claim 1, wherein the cross-sectional area of the at least one passage varies continuously from the first surface to the second surface.

3. The MEMS die of claim 1, wherein the cross-sectional area of the at least one passage is constant through the other of the first and second distinct layers of material.

4. The MEMS die of claim 1, wherein the first layer is an insulative layer that is attached to the substrate and the second layer is a conductive layer disposed on a side of the insulative layer facing the backplate.

5. The MEMS die of claim 4, wherein the insulative layer comprises a layer of Silicon Nitride having a thickness in a range between about 0.2 μm and about 2.0 μm, and the conductive layer comprises a layer of polycrystalline Silicon having a thickness in a range between about 0.2 μm and about 2.0 μm.

6. A microphone device, comprising:

a base having a first surface, an opposing second surface, and a port, wherein the port extends between the first surface and the second surface;

an integrated circuit (IC) disposed on the first surface of the base;

the MEMS die of claim 1 disposed on the first surface of the base; and a cover disposed over the first surface of the base covering the MEMS die and the IC.

7. The MEMS die of claim 1, wherein the at least one passage comprises a circular cross-section at at least one of the first surface and the second surface.

8. The MEMS die of claim 1, wherein the at least one passage comprises a plurality of passages.

9. A microphone device, comprising:

a microelectromechanical system (MEMS) acoustic transducer, comprising:

a substrate having an opening formed therein;

a diaphragm comprising first and second distinct layers of material, wherein the second layer is disposed directly on the first layer, the diaphragm having a first surface attached around a periphery thereof to the substrate and over the opening; and a backplate separated from a second surface of the diaphragm; wherein the diaphragm includes at least one passage disposed between the first and second surfaces, wherein the at least one passage has a smaller cross-sectional area at the first surface than at the second surface; and wherein the cross-sectional area through the first and second layers of material has a profile selected from the group of profiles consisting of:

a first profile wherein the cross-sectional area of the at least one passage varies continuously through both of the first and second distinct layers of material;

a second profile wherein the cross-sectional area of the at least one passage varies continuously through one of the first and second distinct layers of material and is constant through the other of the first and second distinct layers of material; and a third profile wherein the cross-sectional area of the at least one passage is constant through both of the first and second distinct layers of material.

10. The microphone device of claim 9, further comprising:

a base having a first surface, an opposing second surface, and a port, wherein the port extends between the first surface and the second surface; and an integrated circuit (IC) disposed on the first surface of the base; wherein the MEMS acoustic transducer is disposed on the first surface of the base; and a cover is disposed over the first surface of the base covering the MEMS acoustic transducer and the IC.

11. The microphone device of claim 9, wherein the first layer is an insulative layer that is attached to the substrate and the second layer is a conductive layer disposed on a side of the insulative layer facing the backplate.

12. The microphone device of claim 9, wherein the at least one passage comprises a circular cross-section at at least one of the first surface and the second surface.

13. The microphone device of claim 9, wherein the at least one passage comprises a plurality of passages.

14. A microelectromechanical system (MEMS) die, comprising:

a substrate having an opening formed therein;

a diaphragm having a first surface attached around a periphery thereof to the substrate and over the opening; and a backplate separated from a second surface of the diaphragm; wherein the diaphragm comprises first and second distinct layers of material, wherein the second layer is disposed directly on the first layer; wherein the diaphragm includes at least one passage disposed between the first and second surfaces, wherein the at least one passage has a smaller cross-sectional area at the first surface than at the second surface, and wherein the cross-sectional area of the at least one passage is constant through at least one of the first and second distinct layers of material.

15. The MEMS die of claim 14, wherein the cross-sectional area of the at least one passage is constant through both of the first and second distinct layers of material.

* * * * *